US010309586B1

(12) United States Patent
Zhang et al.

(10) Patent No.: US 10,309,586 B1
(45) Date of Patent: Jun. 4, 2019

(54) LIGHT BULB APPARATUS WITH GRAPHITE CAP

(71) Applicant: XIAMEN ECO LIGHTING CO. LTD., Xiamen (CN)

(72) Inventors: Longwei Zhang, Xiamen (CN); Liangliang Cao, Xiamen (CN); Mingyan Fu, Xiamen (CN); Xianghua Lin, Xiamen (CN); Lilei Su, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/921,626

(22) Filed: Mar. 14, 2018

(51) Int. Cl.

| | |
|---|---|
| ***H01J 61/52*** | (2006.01) |
| ***F21K 9/232*** | (2016.01) |
| ***F21K 9/238*** | (2016.01) |
| ***F21V 23/00*** | (2015.01) |
| ***F21K 9/237*** | (2016.01) |
| ***F21K 9/235*** | (2016.01) |
| ***F21V 29/77*** | (2015.01) |
| *F21Y 115/10* | (2016.01) |

(52) U.S. Cl.
CPC ..... *F21K 9/232* (2016.08); *F21K 9/235* (2016.08); *F21K 9/237* (2016.08); *F21K 9/238* (2016.08); *F21V 23/004* (2013.01); *F21V 29/77* (2015.01); *F21Y 2115/10* (2016.08)

(58) Field of Classification Search
CPC ..... F21K 9/232; F21K 9/235; F21K 9/237; F21K 9/238; F21V 29/77; F21V 23/004; F21Y 2115/10
See application file for complete search history.

(56) References Cited

U.S. PATENT DOCUMENTS

| | | | | |
|---|---|---|---|---|
| 8,227,962 | B1 * | 7/2012 | Su | F21K 9/232 313/46 |
| 2010/0227960 | A1 * | 9/2010 | Dobrick | C08G 63/80 524/410 |
| 2011/0156565 | A1 * | 6/2011 | Chin | F21V 3/00 313/46 |
| 2014/0104858 | A1 * | 4/2014 | Holland | B23P 15/26 362/369 |
| 2015/0076395 | A1 * | 3/2015 | Negandhi | F21V 5/04 252/75 |

* cited by examiner

*Primary Examiner* — Tracie Y Green
(74) *Attorney, Agent, or Firm* — Chun-Ming Shih

(57) ABSTRACT

A light bulb apparatus has a LED plate, a cap, a driver circuit and a graphite cup. The graphite cup has a platform part, a container part and a cap part. The platform part is attached to the LED plate. The container part is used for storing the driver circuit and the cap part is used for connecting to the cap so as to install the light bulb apparatus in a standard Edison socket. The graphite cup is molded with a mixed material. The mixed material includes graphite material and is non-conductive.

15 Claims, 10 Drawing Sheets

Fg.8

LIGHT BULB APPARATUS WITH GRAPHITE CAP

FIELD OF INVENTION

The present invention is related to a light bulb apparatus and more particularly related to a high power light bulb apparatus.

BACKGROUND

There are various light bulbs in today's world. Some light bulbs consumes low power and some others consumes high power and emits strong light. For example, in family luminance, 10 W LED is usually sufficient but in industrial or commercial applications, there are vast needs for high power light bulb.

To increase flexibility, most light bulbs have a standard Edison cap to be screwed into a corresponding Edison socket. Though different light bulbs may share the same Edison cap size, they may have quite different power consumption rates.

For high power light bulb, heat dissipation is always a critical issue, particularly for LED devices. Without properly handling heat dissipation, life span and reliability of LED devices may fail to meet expected needs.

In addition, there is usually a need to provide a driver circuit to convert external power source like 110V or 220V alternating electricity to a suitable driving current for LED devices to emit light. If the driver circuit is placed in a metal container, e.g. an aluminum housing, there are certain design rules and corresponding components that need to be used to ensure product safety.

All such technical problems make high power LED light devices difficult to be made or are made of high manufacturing cost. If a better way is found to design such light device, it is very beneficial to improve human life.

SUMMARY OF INVENTION

According to an embodiment of the present invention, a light bulb apparatus is provided for being connected to a power source. For example, the light bulb apparatus is connected to a standard Edison socket to get external electricity.

The light bulb apparatus has a LED plate, a cap, a driver circuit, and a graphite cup. Please be noted that this embodiment is for exemplary purpose, not to limit the present invention to only such configuration. For example, the embodiment may be adjusted to have LED modules arranged on a circular belt and the light emitted from LED modules is emitted to a light guide to convert the light path to desired direction, e.g. downwardly from a ceiling in a downlight device example.

In addition to light bulb, persons of ordinary skilled in the art would understand that the inventive concept covers light bulb apparatus category but is not limited to such product. For example, the following concept may be implemented in downlight devices, as a front light in a car, or any customized industrial and commercial luminance applications. Please follow, however the following disclosure to understand the basic example of this invention.

In this embodiment, the LED plate is mounted with a plurality of LED modules. Such LED plate may have a metal substrate, insulation layer, wire pattern layer and LED modules. The LED modules may be packaged with chip scale package (CSP), chip on board (COB), flip chip or any other package method to be mount on the LED plate.

In this example, the cap has a first electrode and a second electrode for connecting to the power source. For example, the cap is a metal cup complying with an Edison cap standard. The two electrodes are respectively connected to power line of an electricity source.

The driver circuit is connected to the first electrode and the second electrode for converting an external electrical power to a driving current for driving the LED modules on the LED plate to emit light. For example, 110V or 220V alternating electricity is converted direct current electricity to drive the LED modules.

The graphite cup has a platform part, a container part and a cap part. The platform part is used for supporting the LED plate. The container part is used for containing the driver circuit. The cap part is connected to the cap.

In addition, the graphite cup is molded with a mixed material. The mixed material includes graphite material but the mixed material is non-conductive, by adding some additional material as mentioned below. Such graphite has nice heat conductive characteristic while is not conductive. Therefore, the driver circuits do not need additional protective components or follow some design rules of safety standards.

In some embodiments, a first side of the platform part has a flat surface engaging with the LED plate. Specifically, the platform part may have several structures and one of the structures has a flat surface for contacting and supporting the LED plate.

To keep the LED plate more closed contacting with the platform part for better heat dissipation, there are various ways to do so. For example, screws may be used to fasten the LED plate with the platform part. Heat dissipation glue may be applied between the LED plate and the platform part.

In some embodiments, the LED plate is attached to a first side of the platform part, and the second side opposite to the first side may have fins for enhancing heat dissipation and for increasing rigidity of the platform part.

The fins may be protruding curve clips extended from the backside of the platform part or may be a mesh structure which may also increase rigidity of the platform part.

This helps a lot to keep the surface flat particularly when the area of the surface is not small, e.g. with a diameter larger than 10 cm. Therefore, it would be helpful by adding some convex structures to enhance rigidity of the platform part. In such case, the platform part of the graphite cup is a plate with a flat surface in one side and has protruding convex structures in its back side. There may be also a container box in the middle of such plate as the container part for containing driver circuits.

In some embodiments, it is found that the mixed material containing graphite material and several optional material may be used in injection molding. Specifically, raw materials as mentioned below may be mixed, cut, washed to generate particles or grains. Such particle of grains are then placed in a molding with a predetermined shape. It is found with experiments that, at least it is successful by keeping the working temperature between 150 Celsius degree and 400 Celsius degree. Some preferred materials are made between 250 Celsius degree and 300 Celsius degree, but persons of ordinary skilled in the art may adjust certain parameters to create mixed material with different characteristic for different design needs. In addition, it is found 80% to 120% molding pressure, not a limitation to this invention, may be great for forming the mixed material with good heat dissipation characteristic while is not conductive.

In some embodiments, the driver circuit has one or two protruding electrodes passing through one or two through holes of the platform part to be inserted into a pluggable clip of the LED plate to supply the driving current to the LED modules of the LED plate.

In some embodiments, it is found by placing following compositions in the mixed material to create a nice heat dissipation while not conductive material.

Firstly, 20% or more resin material in the mixed material is found helpful. The resin material may be selected from PA6, PBT, PC or PA66 resin material or their combination.

In some experiments, it is found that 30% to 40% weighting ratio of resin material is preferable for building material with nice heat dissipation while non-conductive characteristic that is great to build housing of a light device like a light bulb device.

In some experiments, it is also found that less than 40% weighting ratio of graphite material brings nice characteristic as required. In addition, more than 10% weighting ratio of graphite material may make the mixed material well, too. Preferably, it is found that between 20% to 30% weight ratio of graphite material is good for achieving the goal of the light bulb embodiment.

It is also found that graphite material used in the mixed material may be selected with 120 mesh to 150 mesh gram size. As being known by this field, the mesh size refers to how many filter holes in an area, e.g. 50 mesh referring to 50 holes in an inch square area.

It is also found that by adding glass fiber with less than 30% weighting ratio, and/or larger than 5% weighting ratio of mixed material helps strength the robustness of the mixed material, and also for non-conductivity of the mixed material.

The glass fiber may be replaced by other flexibilizer to increase flexibility of the mixed material.

It is also found that adding retardants larger than 5% weighting ratio in the mixed material helps stabilize the characteristic of the mixed material.

It is also found that adding aluminum oxide larger than 5% and/or less than 30% weighting ratio of the mixed material helps increase heat dissipation and non-conductivity.

Although there are more than one way to shape the mixed material to desired shape, e.g. the light bulb housing, injection molding is found a nice option.

Particularly, with injection molding, instead of metal shaping methods applied to traditional metal material, the same mold device may be used for different light devices with different required levels of heat dissipation and non-conductivity. Meanwhile, these different light devices may even share the same molding devices that have a predetermined shape for the inserted material to form with internal shapes of the molding devices.

For example, there are three types of light bulbs with different levels of heat dissipation and non-conductivity requirements. The first type has largest number LED modules and consumes most electricity. The first type usually generates most heat needed to be dissipated. In such case, certain metal powder, may even been added to the mixed material in addition to graphite material and other materials mentioned above. Adding metal powder may decrease non-conductivity characteristic of the mixed material but may enhance more on heat dissipation.

The second type may use the mixed material as introduced above, which means heat dissipation and non-conductivity are met at the same time. The third type has much less LED modules, and in such case, heat dissipation may not be a first priority. In such case, PC or other plastic material, instead of the mixed material may be used directly.

An advantage is that all three types may share the same molding device, which significantly decreases manufacturing cost of molding devices.

Therefore, another aspect of the present invention includes a method for creating housing of light device components with different heat dissipation and non-conductivity characteristic requirements but with the same shape. Different ratios of materials are mixed to form the mixed material, including the mixed material mentioned above as well as pure plastic material or mixed material with metal powder therein. The molding devices for injection molding are shared by light device components of the same shape but with different heat dissipation and non-conductivity requirements.

Furthermore, in addition to use the mixed material in the specific example of light bulb apparatuses, the mixed material may be widely used in various components, certain part of housing or even whole housing of a light device, particularly when heat dissipation and non-conductivity are critical.

DETAILED DESCRIPTION

Figure 1:
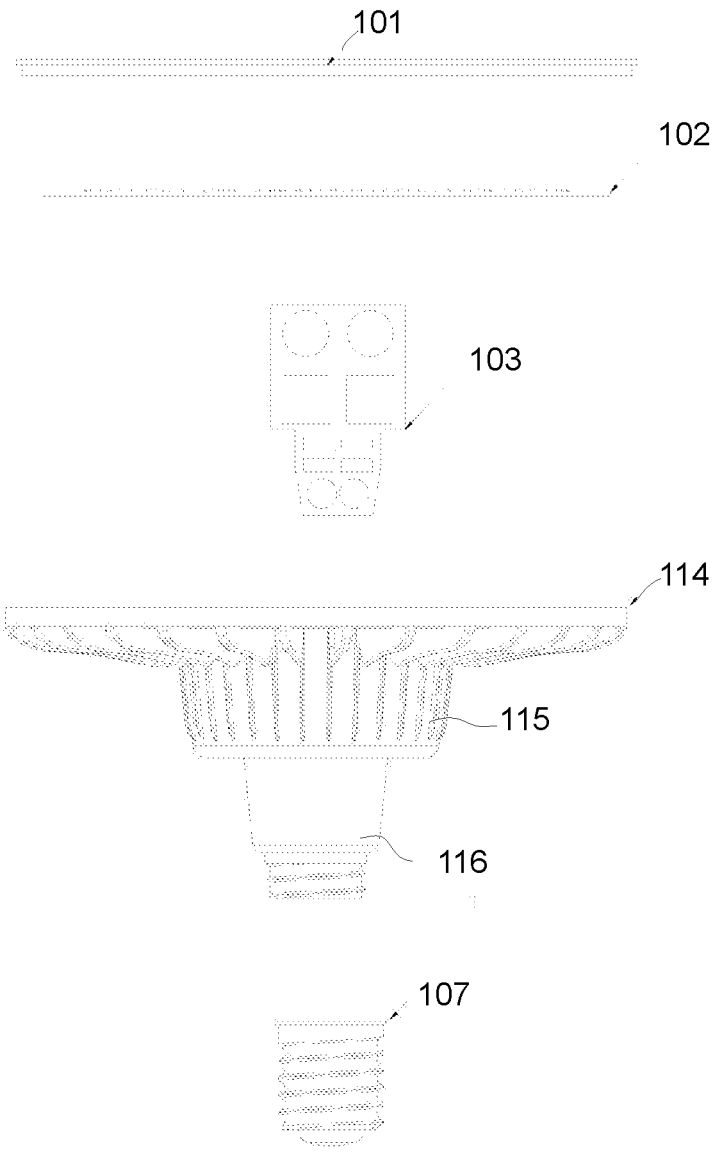
FIG. 1 is an explosive diagram illustrating components of a light bulb embodiment.

Please refer to FIG. 1. FIG. 1 is an explosive diagram illustrating components of a light bulb embodiment.

In FIG. 1, it shows a light bulb apparatus having a lens cover 101, a LED plate 102, a driver circuit board 103 containing driver circuits, a graphite cup having a platform part 114, a container part 115 and a cap part 116, and a cap 107.

In this embodiment, the cap 107 follows the Edison cap standards, so that the cap 107 with two electrodes may be connected to a standard Edison socket to get external power supply.

The lens cover 101 may have lens or a diffusion layer. To have lens, the lens cover 101 provides a focused light beam. To have diffusion layer, the lens cover 101 provides a soften light output. In this example, the lens cover 101 is a flat plate, but this is not supposed to be a limitation of this invention.

A traditional bulb shell shape may be used to replace with the illustrated lens cover 101. Therefore, there may be various implementation styles for the light bulb in addition to the illustrated example.

The LED plate 102 is mounted with multiple LED modules. In this embodiment, the LED plate is a high power example, which means many LED modules are simultaneously mounted on the LED plate, and may generate lots of heat during operation.

The LED plate 102 is fixed to a first side of the platform part 114 of the graphite cup. By attaching the LED plate 102 with the first side of the platform part 114 of the graphite cup, heat generated by the LED plate 102 may be carried away by the graphite cup.

As mentioned above and explained as follows, the graphite cup with the mixed material has nice heat dissipation and non-conductivity characteristic.

In addition, the driver circuit board 103 is contained in an internal space defined by the container part 115 of the graphite cup. Because the graphite cup has non-conductivity characteristic, the driver circuit does not need complicated components or space to meet safety standards, which may greatly decease cost of the light bulb apparatus.

The cap part 116 is connected to the cap 107 to receive external electricity supply, which is routed to the driver circuit board 103 to generate a driving current so as to drive the LED plate to emit light.

Figure 2:
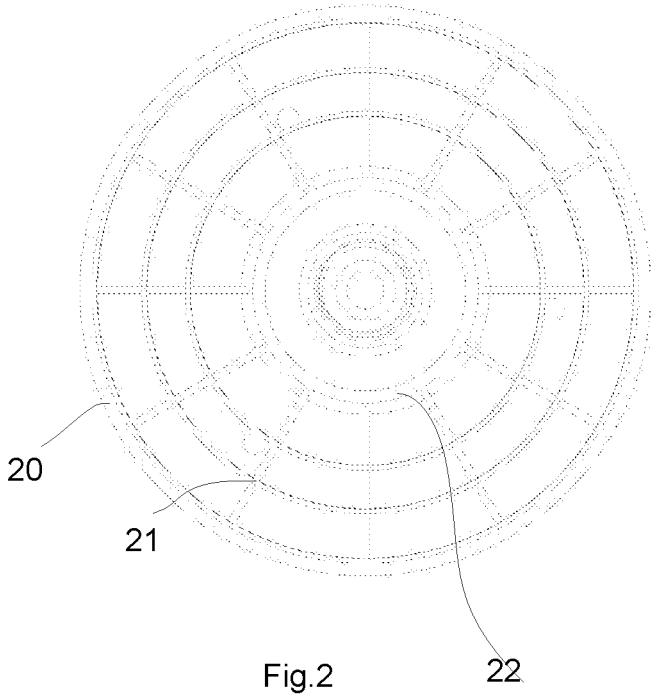
FIG. 2 is a bottom view of a graphite cup.
Figure 3:
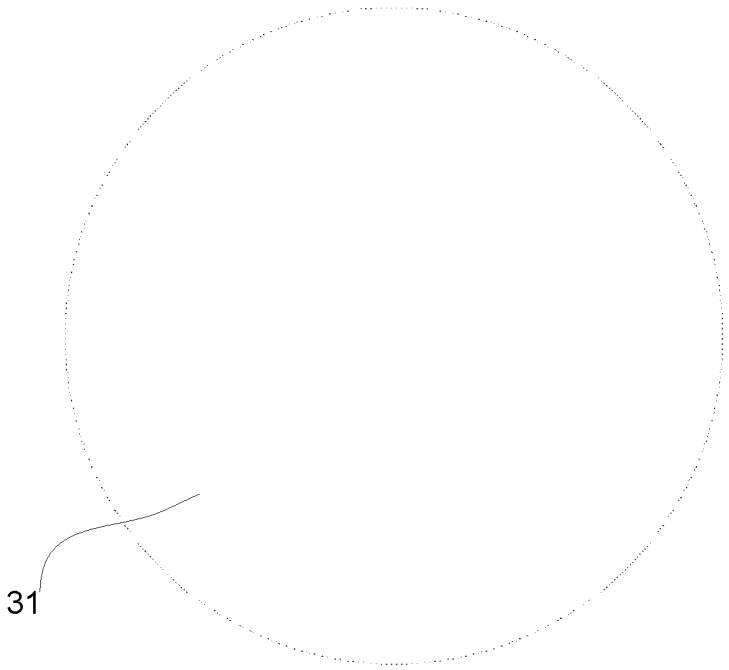
FIG. 3 is a top view of the graphite cup of FIG. 2.
Figure 4:
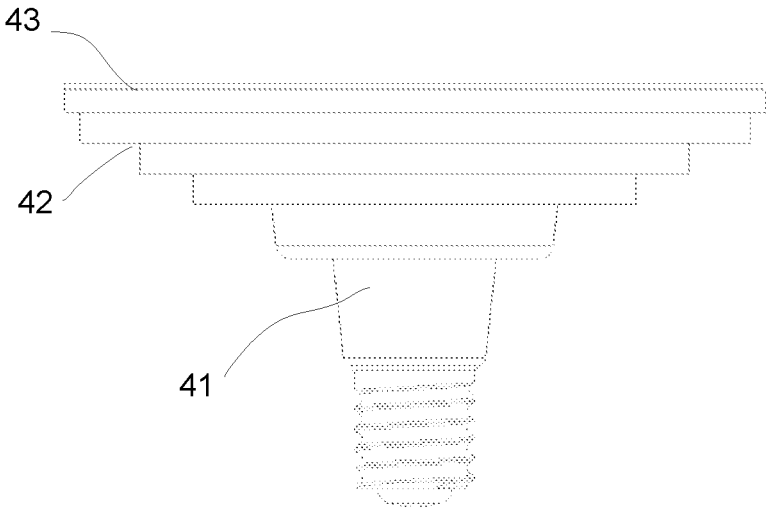
FIG. 4 is a side view of the embodiment.
Figure 5:
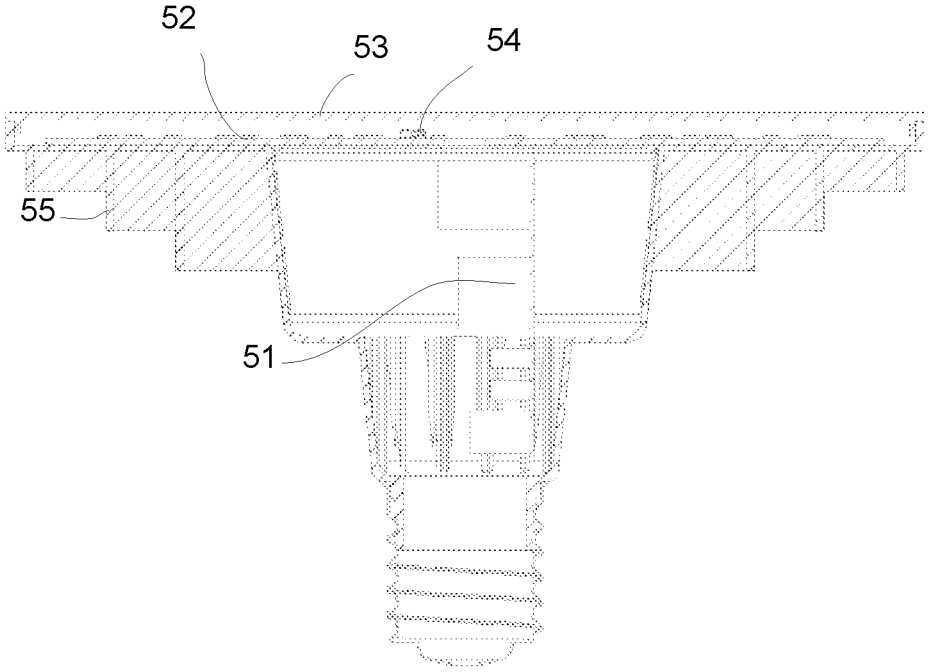
FIG. 5 is a cross-sectional view of the embodiment.

Please refer to FIG. 2, FIG. 3, FIG. 4 and FIG. 5. FIG. 2 is a bottom view of a graphite cup. FIG. 3 is a top view of the graphite cup of FIG. 2. FIG. 4 is a side view of the embodiment. FIG. 5 is a cross-sectional view of the embodiment.

In FIG. 2, it is illustrated a backside of a platform part of a graphite cup 20. Protruding convex structures 21 are formed at the backside of the platform part of the graphite cup 20 to enhance both heat dissipation and rigidity of the graphite cup 20. This means with the same material, the graphite cup 20 may have better structural rigidity.

The middle part of the graphite cup 20 is the cap 22 as mentioned in previous example.

In FIG. 3, the top surface 31 of the graphite cup is flat so that the top surface 31 may fit closely with the LED plate for carrying heat away from the LED plate.

In FIG. 4, it is illustrated that the lens cover 43, the protruding convex structure 42 like fins or mesh may be used for enhancing heat dissipation and structural rigidity.

The cap part 41 of the graphite cup is designed to be easily installed the light bulb to any standard Edison socket. But, as mentioned above, this should not be interpreted as a limiting configuration.

In FIG. 5, it is illustrated that a pluggable clip 54 may receive a pin electrode from the driver circuit 51 via a through hole of the platform part of the graphite cup. The lens cover 53 helps focus or diffuse output light. And the heat of the LED plate 52 is carried out to the mesh structure 55 of the graphite cup.

Figure 6:
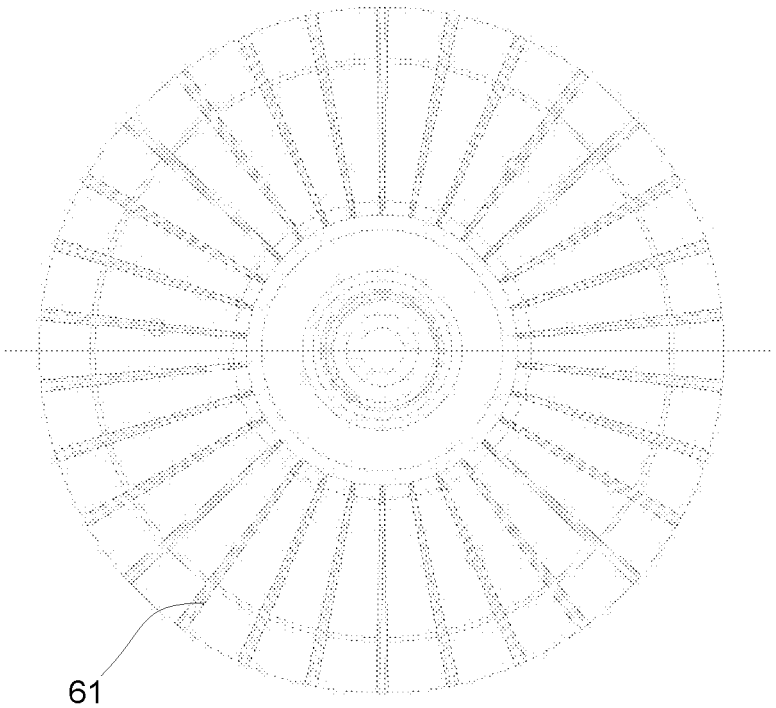
FIG. 6 is a bottom view of another embodiment of light bulb apparatus.
Figure 7:
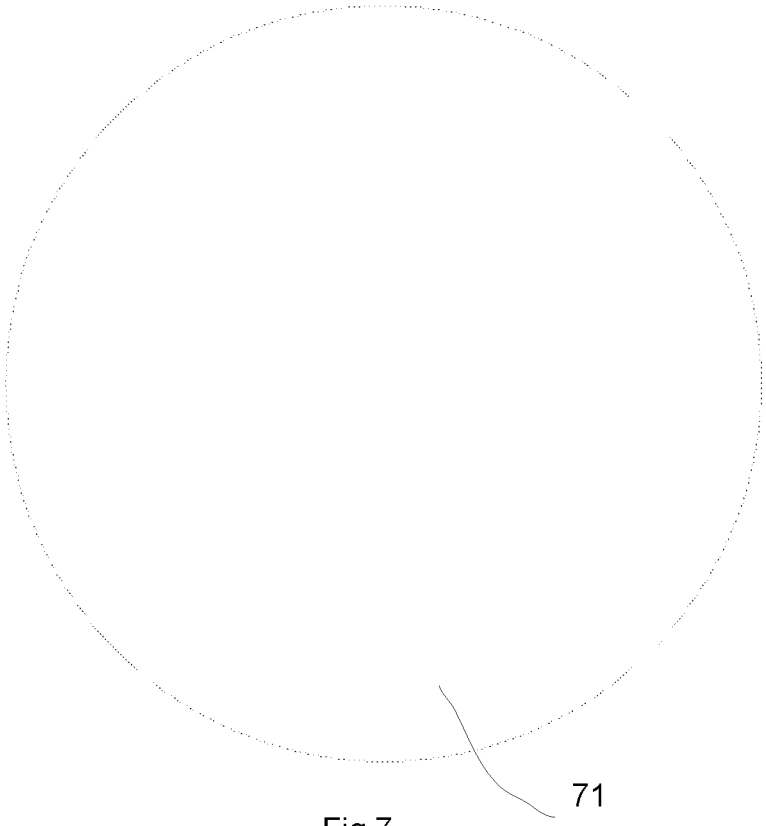
FIG. 7 is a top view of the embodiment.
Figure 8:
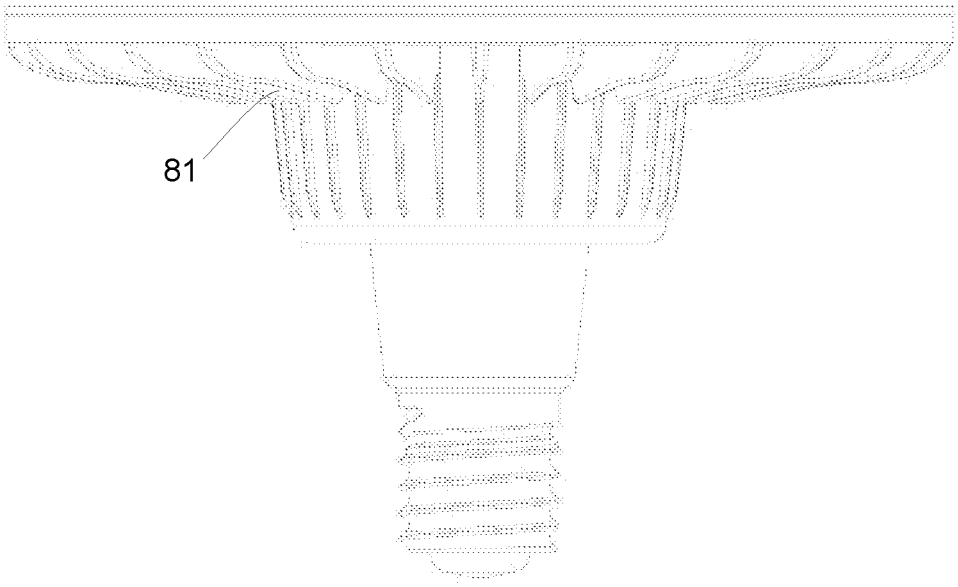
FIG. 8 is a side view of the light bulb apparatus.
Figure 9:
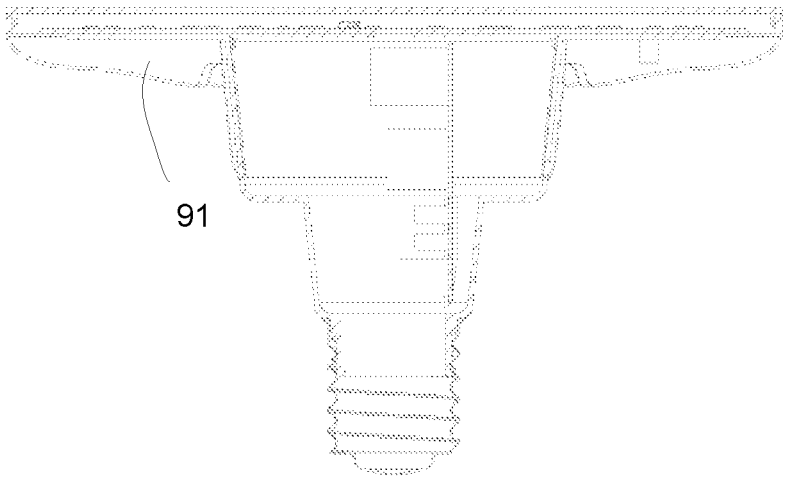
FIG. 9 is a cross-sectional view of the light bulb embodiment.
Figure 10:
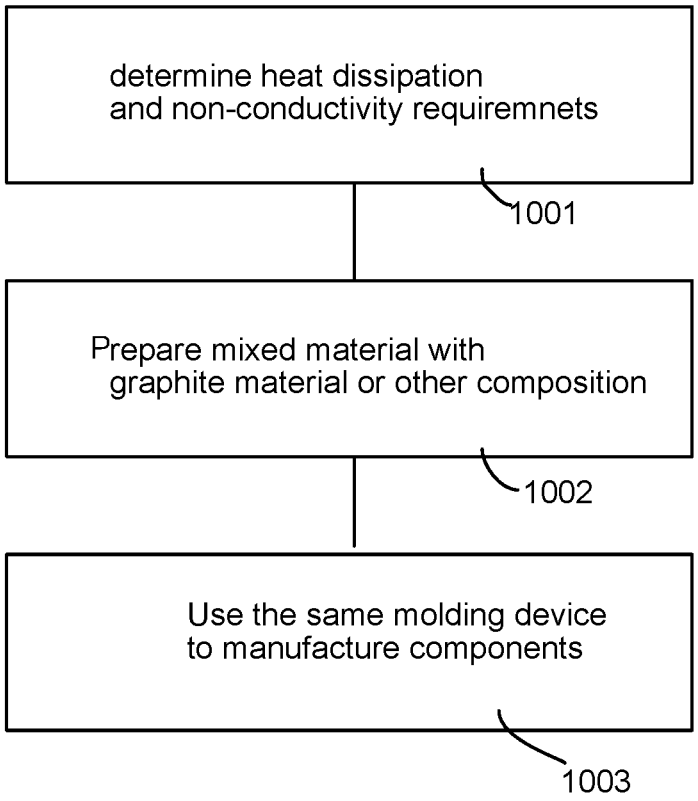
FIG. 10 is a flow chart for manufacturing the light bulb embodiment.

Please refer to FIG. 6, FIG. 7, FIG. 8 and FIG. 9. FIG. 6 is a bottom view of another embodiment of light bulb apparatus. FIG. 7 is a top view of the embodiment. FIG. 8 is a side view of the light bulb apparatus. FIG. 9 is a cross-sectional view of the light bulb embodiment. FIG. 10 is a flow chart for manufacturing the light bulb embodiment.

In FIG. 6, unlike previous example, the protruding convex structure 61 on the back side of the platform part of the graphite cup are fins arranged radially with respect to the center.

In FIG. 7, like the previous example, the lens cover 71 may be flat for condensing light path or diffuse light path, depending on different design requirements.

In FIG. 8, the fins 81 is clearly illustrated, which is not like the mesh structures in previous example.

In FIG. 9, it is clearly shown that the fins may be used for heat dissipation and also for nice appearance. Painting material may be added in the mixed material for the graphite cup to show desired colors, e.g. metal appearance.

According to an embodiment of the present invention, a light bulb apparatus is provided for being connected to a power source. For example, the light bulb apparatus is connected to a standard Edison socket to get external electricity.

The light bulb apparatus has a LED plate, a cap, a driver circuit, and a graphite cup. Please be noted that this embodiment is for exemplary purpose, not to limit the present invention to only such configuration. For example, the embodiment may be adjusted to have LED modules arranged on a circular belt and the light emitted from LED modules is emitted to a light guide to convert the light path to desired direction, e.g. downwardly from a ceiling in a downlight device example.

In addition to light bulb, persons of ordinary skilled in the art would understand that the inventive concept covers light bulb apparatus category but is not limited to such product. For example, the following concept may be implemented in downlight devices, as a front light in a car, or any customized industrial and commercial luminance applications. Please follow, however the following disclosure to understand the basic example of this invention.

In this embodiment, the LED plate is mounted with a plurality of LED modules. Such LED plate may have a metal substrate, insulation layer, wire pattern layer and LED modules. The LED modules may be packaged with chip scale package (CSP), chip on board (COB), flip chip or any other package method to be mount on the LED plate.

In this example, the cap has a first electrode and a second electrode for connecting to the power source. For example, the cap is a metal cup complying with an Edison cap standard. The two electrodes are respectively connected to power line of an electricity source.

The driver circuit is connected to the first electrode and the second electrode for converting an external electrical power to a driving current for driving the LED modules on the LED plate to emit light. For example, 110V or 220V alternating electricity is converted direct current electricity to drive the LED modules.

The graphite cup has a platform part, a container part and a cap part. The platform part is used for supporting the LED plate. The container part is used for containing the driver circuit. The cap part is connected to the cap.

In addition, the graphite cup is molded with a mixed material. The mixed material includes graphite material but the mixed material is non-conductive, by adding some additional material as mentioned below. Such graphite has nice heat conductive characteristic while is not conductive. Therefore, the driver circuits do not need additional protective components or follow some design rules of safety standards.

In some embodiments, a first side of the platform part has a flat surface engaging with the LED plate. Specifically, the platform part may have several structures and one of the structures has a flat surface for contacting and supporting the LED plate.

To keep the LED plate more closed contacting with the platform part for better heat dissipation, there are various ways to do so. For example, screws may be used to fasten the LED plate with the platform part. Heat dissipation glue may be applied between the LED plate and the platform part.

In some embodiments, the LED plate is attached to a first side of the platform part, and the second side opposite to the first side may have fins for enhancing heat dissipation and for increasing rigidity of the platform part.

The fins may be protruding curve clips extended from the backside of the platform part or may be a mesh structure which may also increase rigidity of the platform part.

This helps a lot to keep the surface flat particularly when the area of the surface is not small, e.g. with a diameter larger than 10 cm. Therefore, it would be helpful by adding some convex structures to enhance rigidity of the platform part. In such case, the platform part of the graphite cup is a plate with a flat surface in one side and has protruding convex structures in its back side. There may be also a container box in the middle of such plate as the container part for containing driver circuits.

In some embodiments, it is found that the mixed material containing graphite material and several optional material may be used in injection molding. Specifically, raw materials as mentioned below may be mixed, cut, washed to generate particles or grains. Such particle of grains are then placed in a molding with a predetermined shape. It is found with experiments that, at least it is successful by keeping the working temperature between 150 Celsius degree and 400 Celsius degree. Some preferred materials are made between 250 Celsius degree and 300 Celsius degree, but persons of ordinary skilled in the art may adjust certain parameters to create mixed material with different characteristic for different design needs. In addition, it is found 80% to 120% molding pressure, not a limitation to this invention, may be great for forming the mixed material with good heat dissipation characteristic while is not conductive.

In some embodiments, the driver circuit has one or two protruding electrodes passing through one or two through holes of the platform part to be inserted into a pluggable clip of the LED plate to supply the driving current to the LED modules of the LED plate.

In some embodiments, it is found by placing following compositions in the mixed material to create a nice heat dissipation while not conductive material.

Firstly, 20% or more resin material in the mixed material is found helpful. The resin material may be selected from PA6, PBT, PC or PA66 resin material or their combination.

In some experiments, it is found that 30% to 40% weighting ratio of resin material is preferable for building material with nice heat dissipation while non-conductive characteristic that is great to build housing of a light device like a light bulb device.

In some experiments, it is also found that less than 40% weighting ratio of graphite material brings nice characteristic as required. In addition, more than 10% weighting ratio of graphite material may make the mixed material well, too. Preferably, it is found that between 20% to 30% weight ratio of graphite material is good for achieving the goal of the light bulb embodiment.

It is also found that graphite material used in the mixed material may be selected with 120 mesh to 150 mesh gram size. As being known by this field, the mesh size refers to how many filter holes in an area, e.g. 50 mesh referring to 50 holes in an inch square area.

It is also found that by adding glass fiber with less than 30% weighting ratio, and/or larger than 5% weighting ratio of mixed material helps strength the robustness of the mixed material, and also for non-conductivity of the mixed material.

The glass fiber may be replaced by other flexibilizer to increase flexibility of the mixed material.

It is also found that adding retardants larger than 5% weighting ratio in the mixed material helps stabilize the characteristic of the mixed material.

It is also found that adding aluminum oxide larger than 5% and/or less than 30% weighting ratio of the mixed material helps increase heat dissipation and non-conductivity.

Although there are more than one way to shape the mixed material to desired shape, e.g. the light bulb housing, injection molding is found a nice option.

Particularly, with injection molding, instead of metal shaping methods applied to traditional metal material, the same mold device may be used for different light devices with different required levels of heat dissipation and non-conductivity. Meanwhile, these different light devices may even share the same molding devices that have a predetermined shape for the inserted material to form with internal shapes of the molding devices.

For example, there are three types of light bulbs with different levels of heat dissipation and non-conductivity requirements. The first type has largest number LED modules and consumes most electricity. The first type usually generates most heat needed to be dissipated. In such case, certain metal powder, may even been added to the mixed material in addition to graphite material and other materials mentioned above. Adding metal powder may decrease non-conductivity characteristic of the mixed material but may enhance more on heat dissipation.

The second type may use the mixed material as introduced above, which means heat dissipation and non-conductivity are met at the same time. The third type has much less LED modules, and in such case, heat dissipation may not be a first priority. In such case, PC or other plastic material, instead of the mixed material may be used directly.

An advantage is that all three types may share the same molding device, which significantly decreases manufacturing cost of molding devices.

Please refer to FIG. 10, which illustrates a manufacturing flowchart.

In FIG. 10, another aspect of the present invention includes a method for creating housing of light device components with different heat dissipation and non-conductivity characteristic requirements but with the same shape. Different ratios of materials are mixed to form the mixed material (step 1001), including the mixed material mentioned above as well as pure plastic material or mixed material with metal powder therein (step 1002). The molding devices for injection molding are shared by light device components of the same shape but with different heat dissipation and non-conductivity requirements (step 1003).

Furthermore, in addition to use the mixed material in the specific example of light bulb apparatuses, the mixed material may be widely used in various components, certain part of housing or even whole housing of a light device, particularly when heat dissipation and non-conductivity are critical.

In addition to the above-described embodiments, various modifications may be made, and as long as it is within the spirit of the same invention, the various designs that can be made by those skilled in the art are belong to the scope of the present invention.

The invention claimed is:

1. A light bulb apparatus for being electrically connected to a power source, comprising:

a LED plate mounted with a plurality of LED modules;

a cap having a first electrode and a second electrode for connecting to the power source;

a driver circuit connected to the first electrode and the second electrode for converting an external electrical power to a driving current for driving the LED modules on the LED plate to emit light; and a graphite cup having a platform part, a container part and a cap part, wherein the platform part is used for supporting the LED plate, the container part is used for containing the driver circuit, and the cap part is connected to the cap, and wherein the graphite cup is molded with a mixed material, the mixed material comprises graphite material, and the mixed material is non-conductive, wherein more than 20% weighting ratio of the mixed material is resin material, the resin material is selected from PA6, PC and PA66, the weighting ratio of the resin material is between 30% and 40%, the weighting ratio of the graphite material is less than 40% and larger than 10%.

2. The light bulb apparatus of claim 1, wherein a first side of the platform part has a flat surface engaging with the LED plate.

3. The light bulb apparatus of claim 2, wherein a second side of the platform part opposite to the first side has a fins for enhancing heat dissipation.

4. The light bulb apparatus of claim 2, wherein the flat surface has a diameter larger than 10 cm and a second side of the platform part opposite to the first side has a convex structure to enhance rigidity of the platform part.

5. The light bulb apparatus of claim 1, wherein the graphite cup is made by injection molding with the mixed material.

6. The light bulb apparatus of claim 5, wherein the injection molding process is kept between 150 Celsius degree and 400 Celsius degree.

7. The light bulb apparatus of claim 1, wherein the driver circuit has a protruding electrode passing through a through hole of the platform part to be inserted into a pluggable clip of the LED plate to supply the driving current to the LED modules of the LED plate.

8. The light bulb apparatus of claim 1, wherein the weighting ratio of the graphite material is between 20% and 30%.

9. The light bulb apparatus of claim 1, wherein the graphite material has 120 mesh to 150 mesh gram size.

10. The light bulb apparatus of claim 1, wherein the mixed material comprises glass fiber less than 30% weighting ratio of the mixed material.

11. The light bulb apparatus of claim 1, wherein the mixed material comprises glass fiber larger than 5% weighting ratio of the mixed material.

12. The light bulb apparatus of claim 1, wherein the mixed material comprises flexibilizer for enhancing flexibility of the mixed material.

13. The light bulb apparatus of claim 1, wherein the mixed material comprises flame retardants larger than 5% weighting ratio of the mixed material.

14. The light bulb apparatus of claim 1, wherein the mixed material comprises aluminum oxide larger than 5% weighting ratio of the mixed material.

15. The light bulb apparatus of claim 1, wherein the mixed material comprises aluminum oxide less than 30% weighting ratio of the mixed material.

* * * * *